US006501931B2

(12) United States Patent
Matsumoto

(10) Patent No.: US 6,501,931 B2
(45) Date of Patent: Dec. 31, 2002

(54) IMAGE FORMING APPARATUS

(75) Inventor: Kazuo Matsumoto, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/814,688

(22) Filed: Mar. 15, 2001

(65) Prior Publication Data

US 2002/0159792 A1 Oct. 31, 2002

(51) Int. Cl.[7] ..... G03G 15/00
(52) U.S. Cl. ..... 399/167; 399/16; 399/388
(58) Field of Search ..... 399/16, 18, 167, 399/303, 312, 388

(56) References Cited

U.S. PATENT DOCUMENTS 4,723,145 A * 2/1988 Takada et al. ..... 399/167 X
5,111,242 A * 5/1992 Tanimoto et al. ..... 399/167
5,471,290 A * 11/1995 Nagayama et al. ..... 399/18
5,943,532 A * 8/1999 Ohnuma ..... 399/167

FOREIGN PATENT DOCUMENTS

| | | |
|---|---|---|
| JP | 5-191605 | 7/1993 |
| JP | 05-333619 | * 12/1993 |
| JP | 8-160692 | 6/1996 |
| JP | 11-65222 | 3/1999 |

* cited by examiner

*Primary Examiner*—Sandra Brase
(74) *Attorney, Agent, or Firm*—Foley & Lardner

(57) ABSTRACT

The present invention provides an image forming apparatus, in which a driving device detected by a detecting device sets the control amount in a manner to set the magnitude of the driving signal supplied to first, second and third motors in accordance with generation of the phenomenon for changing the magnitude of the driving signal imparted to the first, second and third motors. In the image forming apparatus of the particular construction, it is possible to suppress the jitter occurrence in the toner image caused by the fluctuation in the load, the fluctuation bringing about fluctuation in the rotating speed of the photosensitive body.

16 Claims, 12 Drawing Sheets

AFC WAVEFORM AMPLITUDE

APC WAVEFORM AMPLITUDE

AFC WAVEFORM AMPLITUDE

APC WAVEFORM AMPLITUDE

IMAGE FORMING APPARATUS

BACKGROUND OF THE INVENTION

The present invention relates to an image forming apparatus represented by, for example, an electro-photographic type electronic copying machine and a printer.

In general, an image forming apparatus is constructed as follows. Specifically, a toner image is formed by an image forming unit consisting of a photosensitive body and a developing device. The formed toner image is transferred onto a transfer medium such as a paper sheet or a transparent resin sheet for an overhead projector, which is transferred by a transfer belt. The transfer medium having the toner image transferred thereonto is heated so as to fix the toner image to the transfer medium.

In the image forming apparatus of the construction described above, the photosensitive body is rotated in general at a predetermined peripheral speed by a DD (Direct Drive) motor. However, it is known to the art that, where the DD motor is rotated at an angular speed not higher than, for example, 80 rpm, the angular rotating speed is changed by the cogging component inherent in the motor. In order to lower the influence given by the cogging component, a method of mounting a fly-wheel to the rotary shaft of the motor is widely employed for increasing the inertia moment. However, it is difficult to remove completely the fluctuation of the rotation.

Also, in the image forming apparatus, the load fluctuation is generated when, for example, the transfer medium enters or passes through the region between the photosensitive body and the transfer belt so as to bring about jitter in the formed toner image.

It is known to the art that, since the constant parameter of the compensation circuit for controlling the rotation of the DD motor is fixed to a predetermined value, the fluctuation of the rotation referred to above is generated by the non-uniformity of the motor constant (coil or magnetization) or by the influence produced by the load fluctuation.

Various measures are proposed to date in order to suppress the jitter occurrence. For example, it is proposed in Japanese Patent Disclosure (Kokai) No. 5-191605 that the driving period of a stepping motor for rotating the photosensitive drum is aligned with the period of the light exposure timing (light-emitting timing of a laser element) of the light exposure device. Also, it is proposed in Japanese Patent Disclosure (Kokai) No. 8-160692 that the gear ratio in the motor driving section is made an integer number times as much as the reference frequency of the stepping motor. Further, it is proposed in Japanese Patent Disclosure (Kokai) No. 11-65222 that the rotating speed fluctuation of the photosensitive body is reflected in the transfer belt by utilizing a regenerative electromotive force of the motor so as to suppress the load fluctuation.

However, it is difficult to remove completely the jitter contained in the toner image by any of the motor control methods proposed in the prior arts referred to above.

BRIEF SUMMARY OF THE INVENTION

An object of the present invention is to provide an image forming apparatus, which permits optimizing the drive control of the motor so as to suppress the jitter occurrence in the toner image caused by the fluctuation in the rotating speed of the photosensitive body, which is caused by the load fluctuation.

Another object of the present invention is to provide an image forming apparatus, which permits suppressing the jitter occurrence by using a servo compensation system, in which the parameter constant used for driving the motor is made programmable, so as to make the circuit constant for the compensation system manually changeable in the direction in which the detected error in the rotating speed is made smaller.

A still another object of the present invention is to provide an image forming apparatus, which permits suppressing the jitter occurrence by using a servo compensation system, in which the parameter constant used for driving the motor is made programmable, so as to make the circuit constant for the compensation system automatically changeable in the direction in which the detected error in the rotating speed is made smaller.

According to a first aspect of the present invention, there is provided an image forming apparatus, comprising:

- a first motor for rotating a photosensitive member at a predetermined speed;
- a second motor for transferring a transfer medium onto which the toner image formed on the photosensitive member is transferred at a speed equal to the moving speed of the photosensitive member;
- a third motor for supplying the transfer medium toward the photosensitive member at a predetermined speed;
- a driving device supplying driving signals to the first, second and third motors;
- a detecting mechanism for detecting the occurrence of a phenomenon for changing the magnitude of the driving signals supplied from the driving device to the first, second and third motors; and
- an input device for changing the magnitude of the driving signals supplied from the driving device to the first, second and third motors on the basis of the occurrence of the phenomenon detected by the detecting mechanism.

According to a second aspect of the present invention, there is provided an image forming apparatus, comprising:

- a first motor for rotating a photosensitive member at a predetermined speed;
- a second motor for transferring a transfer medium onto which the toner image formed on the photosensitive member is transferred at a speed equal to the moving speed of the photosensitive member;
- a third motor for supplying the transfer medium toward the photosensitive member at a predetermined speed;
- a driving device supplying driving signals to the first, second and third motors;
- a detecting mechanism for detecting the occurrence of a phenomenon for changing the magnitude of the driving signals supplied from the driving device to the first, second and third motors; and
- a control amount setting mechanism for setting the magnitude of the driving signals supplied from the driving device to the first, second and third motors on the basis of the occurrence of the phenomenon detected by the detecting means.

Further, according to a third embodiment of the present invention, there is provided a method of setting the image forming conditions of an image forming apparatus, in which the magnitude of the jitter contained in the toner image formed in the image forming apparatus is detected and the image forming conditions are set in a manner to minimize the magnitude of the jitter, comprising the steps of:

monitoring the fluctuation in the magnitude of the motor current supplied from a motor driving device for driving a first motor to the first motor so as to detect the fluctuation in the rotating speed of the first motor;

operating a second motor for transferring a transfer medium onto which the toner image formed the photosensitive body is transferred at a speed equal to the moving speed of the photosensitive body and a third motor for supplying the transfer medium toward the photosensitive body at a predetermined speed; and setting the magnitude and the phase of the motor current supplied to the motor driving device so as to minimize the fluctuation in the rotating speed of the first motor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, and serve to explain the principles of the present invention.

DETAILED DESCRIPTION OF THE INVENTION

A color image forming apparatus to which a preferred embodiment of the present invention is applied will now be described with reference to the accompanying drawings.

Figure 1:
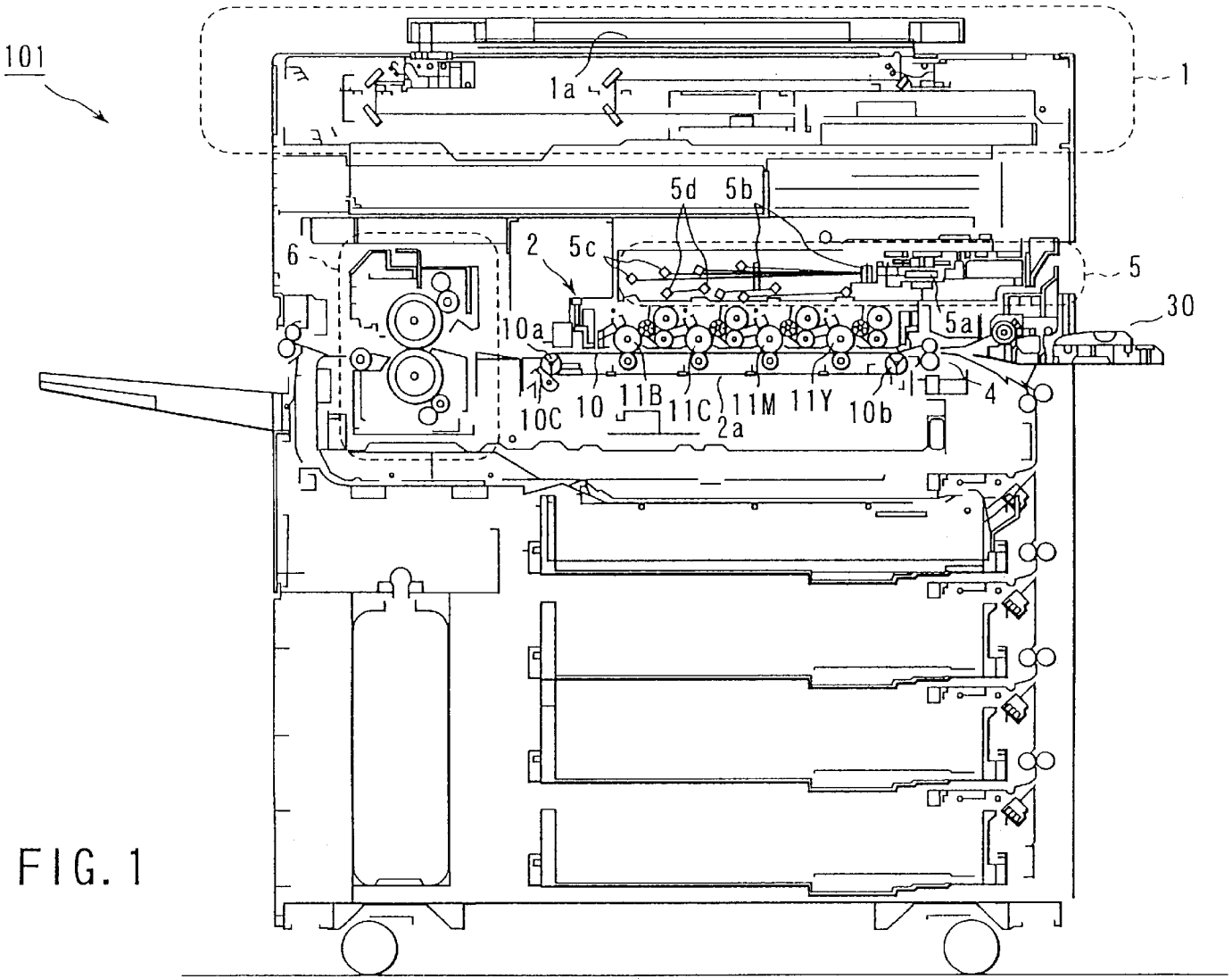
FIG. 1 schematically shows the construction of a four drum type color image forming apparatus to which one embodiment of the present invention is applied.

FIG. 1 schematically shows an electrophotographic color image forming apparatus, i.e., a four drum type color copying apparatus 101 in which a plurality of electrophotographic image forming sections are arranged in contact with the same transfer belt. The color copying apparatus 101 shown in FIG. 1 comprises an original table 1*a* on which an original to be copied such as a book is disposed. The image of the original (not shown) disposed on the original table 1*a* is read by a scanner 1 so as to obtain an image data. The image data thus obtained or the image data supplied from an external apparatus (not shown) represented by, for example, an electronic computer is stored in an image memory, which will be described herein later. The image data stored in the image memory is processed in an image data processing circuit, which will be described herein later with reference to FIGS. 3A and 3B, so as to form a color image in an image forming unit 2 described herein later. It is possible to utilize as the image data an optional data type that can be applied to each of R. G. B. (additive primaries) or C. M. Y. (subtractive primaries).

Figure 2:
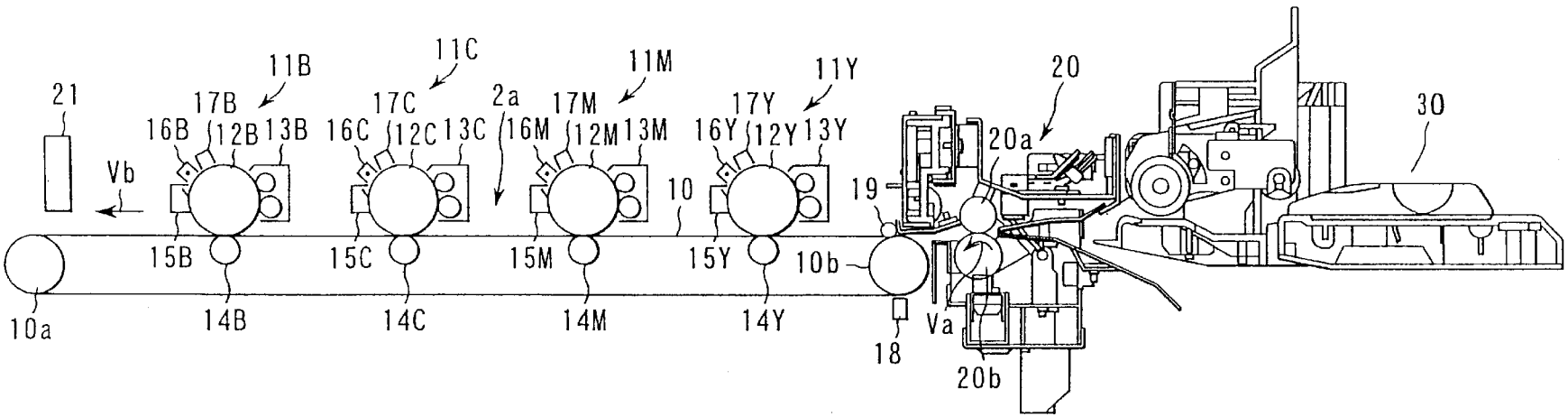
FIG. 2 schematically shows the image forming unit of the color image forming apparatus shown in FIG. 1.

As shown in FIG. 2 in a magnified fashion, the image forming unit 2 comprises first, second, third and fourth image forming sections 11 for forming toner images of four colors on the basis of four image forming signals Y (yellow), M (magenta), C (cyan) and B (blacking) color-decomposed on the basis of the subtractive primaries. Incidentally, the image forming sections 11 and the many factors constituting the image forming sections 11 are arranged for four sets for the colors of Y, M, C and B and, thus, accompanying letters Y, M, C and B are added, if required, in the following description for discrimination of the constituents of the apparatus.

Each of the image forming sections 11 is arranged to face an endless belt (transfer belt) 10 for transferring a sheet material O used as a transfer material (medium onto which a toner image is transferred) such as a paper sheet or a transparent resin sheet for an overhead projector, with a predetermined clearance provided between the image forming section 11 and the endless belt 10. Also, the image forming sections 11 are arranged a predetermined distance apart from each other in the running direction of the transfer belt 10.

A photosensitive drum 12 on which is formed a latent image corresponding to each of the image forming signals of Y, M, C and B and a developing device 13 housing a toner of each of the colors of Y, M, C and B for visualizing the latent image formed on the photosensitive drum 12 are incorporated in each of the image forming sections 11. The order of arranging the individual image forming sections 11 is optional. In the embodiment shown in the drawing, the image forming sections 11 for Y, M, C and B are arranged in the order mentioned in the moving direction of the sheet material O so as to permit the four colors of the Y image, the M image, the C image and the B image to be superposed in the order mentioned.

A transfer device 14 for electrostatically attracting the toner image formed on the photosensitive drum 12 onto the sheet material O, which is electrostatically held by the transfer belt 10, is arranged in a position facing the photosensitive drum 12 with the transfer belt 10 interposed therebetween in each of the image forming sections. Also arranged around each of the photosensitive drums 12 are a cleaner 15 for removing the residual toner on the surface of the photosensitive drum after transfer of the toner image onto the sheet material O, which is performed by the transfer device 14, a charge eliminating device (destaticizer) 16 for eliminating the residual charge on the photosensitive drum after removal of the residual toner by the cleaner 15, and a charging device 17 for imparting a predetermined potential to the photosensitive drum 12.

The transfer belt 10, which is formed of a conductive urethane rubber and has a thickness of about 0.5 mm, is stretched between a first roller (driving roller) 10*a* and a second roller (driven roller) 10*b*. In accordance with rotation of the driving roller 10*a*, an optional point of the transfer belt is moved in a predetermined direction. Needless to say, the optional point of the transfer belt 10 is moved in the transfer direction of the sheet material O. Also, in the embodiment shown in the drawing, the sheet material O is transferred from the first image forming section 11Y toward the fourth image forming section 11B. It should be noted that a transfer unit 2*a* including the transfer belt 10, the driving roller 10*a*, the driven roller 10*b*, a belt motor for driving the driving roller 10*a*, etc. is integrally brought into contact with and moved away from the photosensitive drums 12 of all the image forming sections 11 in forming a single color toner image (B toner image), as shown in FIG. 2 and described herein later.

A suction charger 18 for electrostatically charging the transfer belt 10 to allow the transfer belt 10 to electrostatically hold the sheet material O is arranged in a predetermined position in the vicinity of a transfer medium supply section 4 for supplying the sheet material O onto the transfer belt 10 on the side of the first image forming section 11Y. Also, a suction roller 19 for bringing the sheet material O into tight contact with the transfer belt 10 charged in advance by the charger 18 is arranged on the outer circumferential surface of the transfer belt 10 slightly downstream of the transfer medium supply section 4 in the transfer direction of the sheet material O.

An aligning section 20 is arranged between the transfer belt 10 and the transfer medium supply section 4 in a position closer to the transfer medium supply section 4 than the position where the sheet material O is supplied to the outer circumferential surface of the transfer belt 10 and slightly apart from the transfer belt 10. The aligning section 20 serves to align the sheet material O such that the tip portion of the sheet material O supplied toward the outer circumferential surface of the transfer belt 10 is positioned at right angles relative to the transfer direction of the sheet material O and the sheet material O is transferred while maintaining the right angles relative to the transfer direction of the sheet material O.

The aligning section 20 includes first and second aligning rollers 20*a* and 20*b* having the sheet material O sandwiched therebetween and an aligning motor 20*m* (shown in FIGS. 3A, 3B) for driving one of the first and second aligning rollers 20*a* and 20*b*. The sheet material O is aligned such that the first and second rollers 20*a* and 20*b* receive the tip portion of the sheet material O transferred from the transfer medium supply section 4, with rotation of the first and second rollers stopped, and the transfer of the sheet material O is once stopped so as to warp the tip portion of the sheet material O. When the warped tip portion of the sheet material O is brought back to the original state by the rotation of the rollers 20*a* and 20 at a predetermined timing, the sheet material O is transferred with the tip portion of the sheet material O held at right angles relative to the transfer direction of the sheet material O and the sheet material O is transferred while maintaining the right angles relative to the transfer direction of the sheet material O.

A light exposure device 5 is arranged in a predetermined position above each of the image forming sections 11 of the image forming unit 2. The light exposure device 5 includes a laser diode (not shown) or the like that emits the light for the light exposure (laser beam) at the timing set in a control circuit 113 for controlling the timing of the toner image formation in response to the image forming signal subjected to the image processing for the image data for each color by an image data control section 115, which will be described herein later with reference to FIGS. 3A and 3B.

The photosensitive drum 12 is irradiated with the laser beam emitted from the laser diode via a plurality of cylinder lenses 5*b*, a plurality of plane mirrors 5*c*, 5*d*, etc. The intensity of the laser beam emitted from the laser diode is changed in accordance with the image forming signal corresponding to each color and is deflected by, for example, a polygon mirror 5*a* in the axial direction of the photosensitive drum 12, i.e., the direction perpendicular to the transfer direction of the sheet material O. As a result, a latent image corresponding to each color is formed on the photosensitive drum included in the image forming section 11.

A fixing device 6 for fixing the toner image of the four colors held on the sheet material O to the sheet material O is arranged in a position further apart from the first roller 10*a* in the direction in which the sheet material O is transferred by the transfer belt 10.

The fixing device 6 has a cylindrical first roller (heating roller) formed in a predetermined thickness, a second roller (pressurizing roller) having the axis parallel to the axis of the first roller, extending in the longitudinal direction of the first roller, and brought into contact in a single point of the circumferential surface with the first roller, and a heater for heating at least one of these first and second rollers. The sheet material O is passed through the clearance between the first and second rollers with a predetermined pressure applied between these first and second rollers so as to heat and pressurize the sheet material O and the toner electrostatically attached to the sheet material O. As a result, the toner is fixed to the sheet material O.

Figure 3A:
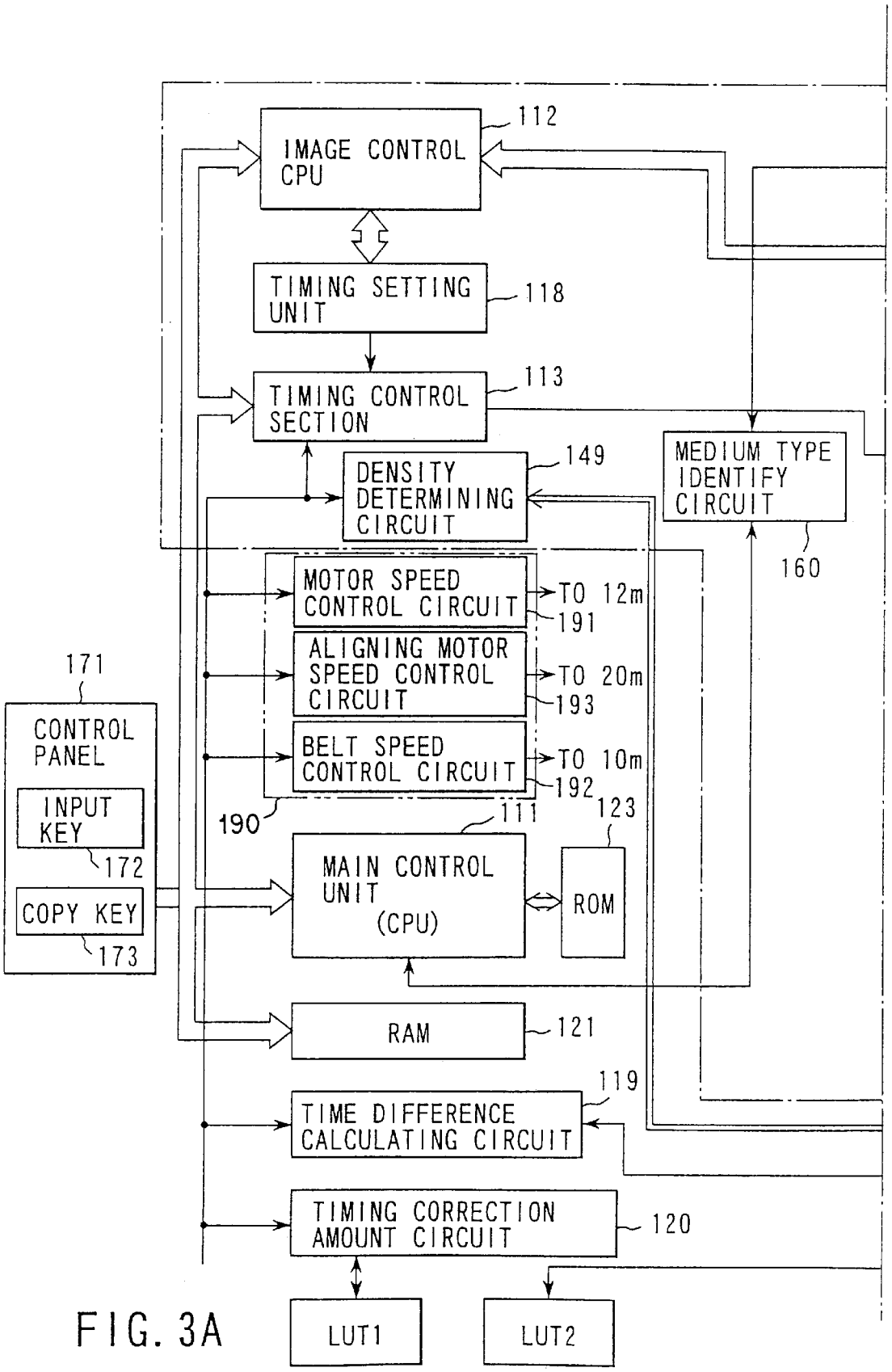
FIGS. 3A and 3B are block diagrams schematically showing the control system of the image forming apparatus shown in FIG. 1.
Figure 3B:
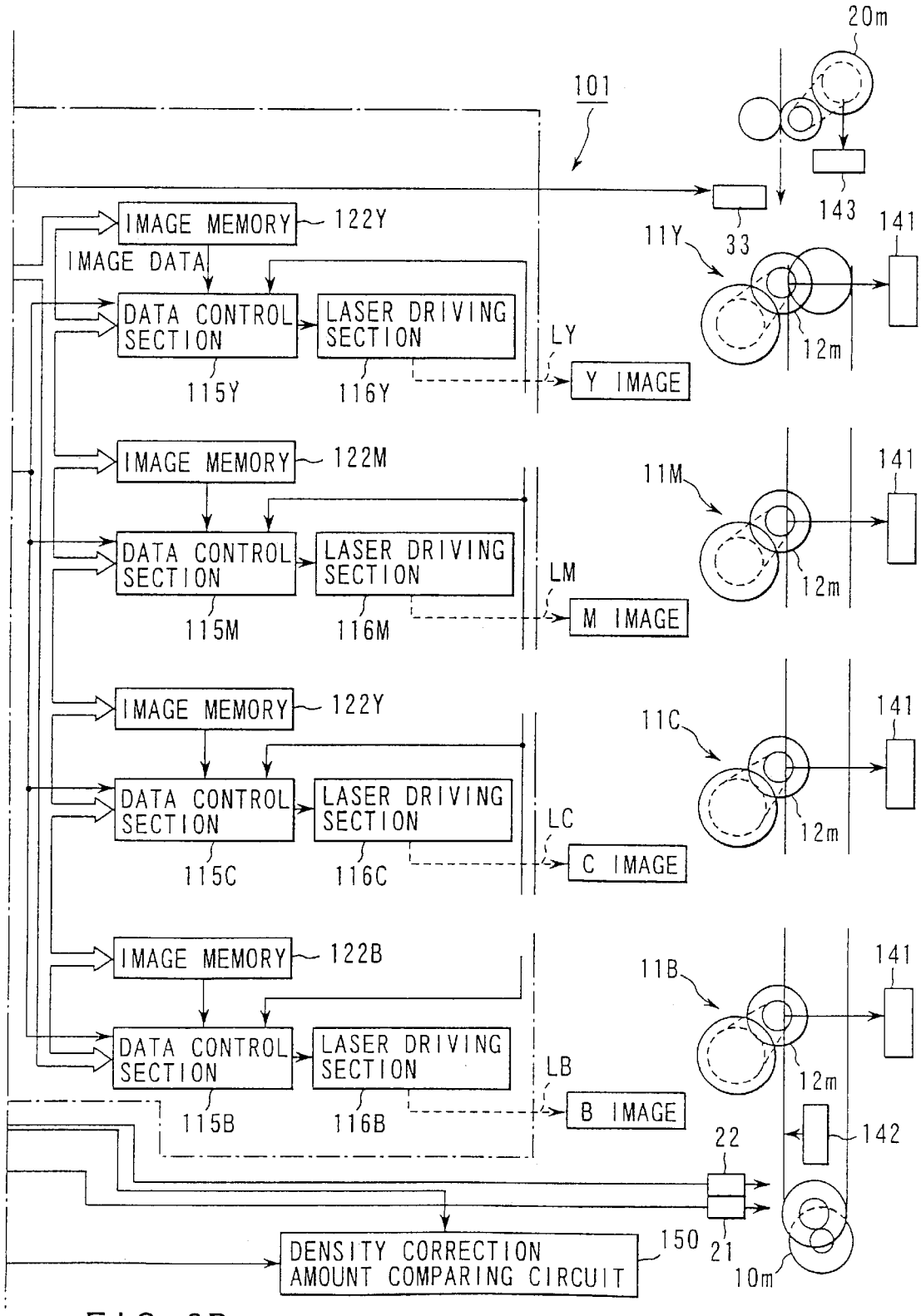

FIGS. 3A and 3B are block diagrams schematically showing as an example the control circuit for controlling the four image forming sections 11Y, 11M, 11C and 11B included in the color copying machine shown in FIG. 1.

When an image formation initiating signal is supplied from an operation panel or a host computer, each of the image forming sections 11Y, 11M, 11C and 11B is warmed up under the control performed by a main control device 111. At the same time, the polygonal mirror 5*a* of the light exposure device 5 is rotated at a predetermined rotating speed under the control performed by an image control CPU 112.

Then, an image data to be printed is taken from an external device such as the scanner 1 or an electronic computer into a RAM 121, which is a work memory, under the control performed by the main control device 111. A part or all of the image data taken into the RAM 121 is housed in four image memories 122 (Y, M, C and B) under the control performed by the image control CPU 112.

Also, the sheet material O is supplied from a cassette or a by-pass supply section 30 toward the transfer medium supply section 4 at a predetermined timing, e.g., on the basis of the vertical synchronizing signal or the like supplied from the control section 113, under the control performed by the main control device 111. The sheet material O transferred into the transfer medium supply section 4 is further transferred toward the image forming section 11 in accordance with rotation of the transfer belt 10. For this transfer, the sheet material O is brought into tight contact with the transfer belt 10 by the suction roller 19. Also, the timing of transferring the sheet material O is aligned by the aligning section 20, in which the first and second aligning rollers are brought into mutual contact, with the timing of the toner images of Y, M, C and B that are provided by the image forming operations of the image forming sections 11 (Y, M, C and B).

On the other hand, in parallel to or simultaneously with the feeding and the transfer operation of the sheet material O, the laser diode for each color of the light exposure device 5 is urged by the corresponding laser driving section 116 (Y, M, C and B) on the basis of a clock signal CLK emitted from a timing setting device (clock circuit) 118.

Also, the intensity is modulated in accordance with the image data DAT stored in the RAM 121 under the control performed by the corresponding data control section 115 (Y, M, C and B) so as to cause the laser diode to emit light. As a result, the photosensitive drum 12 in the image forming section is successively irradiated with the laser beam for one line starting with a predetermined position of the effective printing width in the main scanning direction parallel to the axial direction of the photosensitive drum 12. Also, the photosensitive drum 12 included in the image forming section 11 is successively irradiated with the laser beam for one line in the rotating direction of the photosensitive drum 12 because the photosensitive drum 12 is rotated at a predetermined speed by the drum motor 12*m*. As a result, electrostatic images for four colors are formed in the photosensitive drums 12 (Y, M, C and B) to which a predetermined surface potential is imparted in advance.

These four latent images are developed by the toners having the corresponding colors by the corresponding developing devices 13 (Y, M, C and B) so as to form toner images.

Each toner image is transferred toward the sheet material O transferred by the transfer belt 10 in accordance with rotation of the photosensitive drums 12 (Y, M, C and B) and is successively transferred in the transfer position, in which the transfer belt 10 is brought into contact with the photosensitive drum 12, onto the sheet material O held on the transfer belt 10 by the transfer device 14. As a result, the toner image of the four colors accurately superposed one upon the other is formed on the sheet material O.

The sheet material O electrostatically holding the toner image of the four colors is transferred by the transfer belt 10 and is separated from the transfer belt 10 because of the difference between the curvature of the belt driving roller 10*a* and the straight running properties of the sheet material O so as to be guided into the fixing device 6.

The sheet material O guided into the fixing device 6 is heated by the heat of the fixing device 6. As a result, the toners of the four colors supported on the sheet material O are melted and mixed with each other so as to develop a predetermined color. Then, the color image thus formed is fixed, followed by discharging the sheet material O bearing the color image into a discharge tray (not shown).

In the color copying machine 101 constructed as described above, the four photosensitive drums 12 (Y, M, C and B) in the four image forming sections 11Y, 11M, 11C and 11B are rotated at an optional angular speed by the individual drum motors 12*m* (Y, M, C and B). It follows that the moving speed of an optional point on the outer circumferential surface of the drum motor 12*m*, i.e., the peripheral speed of the drum, is not necessarily constant, compared with the transfer speed of the sheet material O.

Under the circumstances, the angular speed of the individual drum motor 12*m* is detected by a frequency generator 141 so as to be transferred to a motor speed control circuit 191 for a motor driver 190 as a speed detecting signal Vmdet.

The angular speed of the individual drum motor 12*m* is controlled at a constant speed. It should be noted in this connection that the reference value Vmref of a speed signal is set such that the moving speed of the outer circumferential surface of each of the photosensitive drums 12 is made equal to the speed at which an optional point of the transfer belt 10 is moved by the feedback control performed by the control circuit 191. The reference value Vmref thus set is compared with the speed signal Vmdet detected by the frequency generator 141 so as to obtain a difference Vmerr. What should be noted is that the difference signal Vmerr is amplified so as to be fed back to the angular speed of each of the drum motors 12*m*, thereby controlling the angular speed of the drum motor 12*m* at a constant speed. Incidentally, the transfer speed of the sheet material O, the drum peripheral speed of each of the photosensitive drums 12, and the moving speed of the optional point of the transfer belt 10 is equal to each other and is called, for example, a process speed.

Similarly, the angular speed of the belt motor 10*m* for rotating the driving roller 10*a* for moving the transfer belt 10 in the transfer direction of the sheet material O at a predetermined speed is controlled at a constant speed. It should be noted in this connection that a speed signal Vbdet generated from a belt speed detector 142 is supplied to a belt speed control circuit 192. Also, a reference value Vbref of the speed detection signal, which is set such that the outer circumferential speed of the photosensitive drum is made equal to the speed of the transfer belt 10 by the feedback control performed by the control circuit 192, is compared with a speed signal Vbdet detected in the belt speed detector 142 so as to obtain a difference Vberr. The difference Vberr thus obtained is amplified so as to be fed back to the angular speed of the belt motor 10*m*, with the result that the angular speed of the belt motor 10*m* is controlled at a constant speed, as described above.

On the other hand, the angular speed of the aligning motor 20*m* for rotating one of the aligning rollers 20*a* and 20*b* at a predetermined speed is supplied as a speed signal Vadet generated from an aligning motor speed detector 143 to an aligning motor speed control circuit 193 included in a motor driver 190 so as to be compared with the reference value Varef, with the result that the angular speed of the aligning motor 20*m* is controlled at a constant speed during rotation of the aligning motor 20*m*.

In the color copying apparatus 101 of the construction described above, an electrostatic latent image is formed on the photosensitive drum 12 (Y, M, C and B) included in the image forming section 11(Y, M, C and B). Then, the toner of the corresponding color is selectively supplied to the electrostatic latent image formed on the photosensitive drum (Y, M, C and B) in the developing device 13 (Y, M, C and B) so as to form the toner image (Y, M, C and B). The toner image thus formed is electrostatically sucked by the sheet material O so as to be transferred onto the sheet material O transferred by the movement of the transferred belt 10. The transfer of the toner image onto the sheet material O is performed by the transfer device 14.

It should be noted that the moving speed of the outer circumferential surface of the photosensitive drum 12 and the speed Vb of the transfer belt 10 are controlled to be equal to each other as described previously, with the result that the toner is not deviated nor blurred in the ideal case.

It should also be noted that the contact portions between the transfer belt 10 and the four photosensitive drums 12 are positioned apart from each other in the moving direction of the transfer belt 10. As a result, the timings of forming the toner images in the individual image forming sections 11 (Y, M, C and B) are shifted in time in an amount corresponding to the value (process speed) of, $$\frac{\text{represents the distance between the adjacent photosensitive drums}}{\text{represents the speed of the transfer belt 10}}$$

The color toner image prepared by superposing the toner images of the four colors on the sheet material O is fixed to the sheet material O by the fixing device 6.

Figure 4:
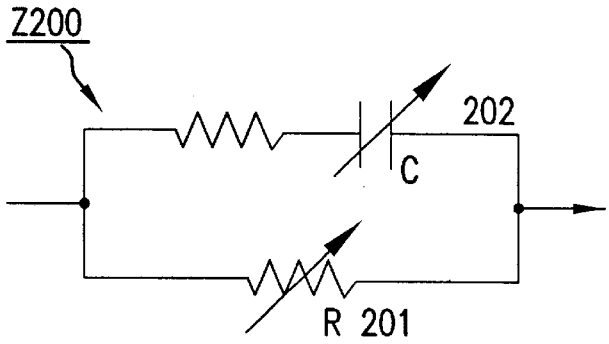
FIG. 4 is a block diagram schematically showing the circuit of a servo compensation system, in which the speed control system and the phase control system applicable to a motor driver, which are included in the control block of the image forming apparatus shown in FIGS. 3A and 3B, are made programmable in the analog control.

FIG. 4 is a block diagram for explaining the circuit for the servo compensation system, in which the speed control system and the phase control system applicable to a motor driver, which are included in the control block of the image forming apparatus shown in FIGS. 3A and 3B, are made programmable under the analog control. As apparent from the drawing, a servo system Z200 consists of variable resistors 201 connected in parallel and a variable capacitor C202. Needless to say, the resistance value of the variable resistor 201 and the capacitance value of the variable capacitor 202 are manually set.

Figure 5:
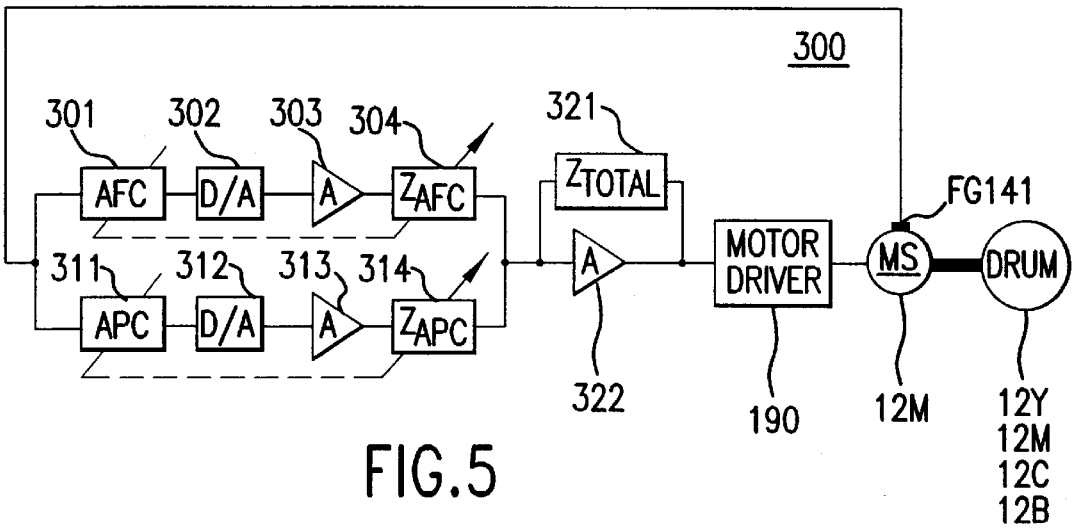
FIG. 5 is a block diagram schematically showing the circuit of a servo compensation system, in which the speed control system and the phase control system applicable to a motor driver, which are included in the control block of the image forming apparatus shown in FIGS. 3A and 3B, are made programmable, said block diagram schematically showing the specific construction for making the values of R and C within the compensation circuit shown in FIG. 4 variable in order for the operator to manually vary the values of R and C so as to minimize the output amplitude of the AFC waveform and APC waveform.

FIG. 5 is a block diagram for explaining the circuit for the servo compensation system, in which the speed control system and the phase control system applicable to a motor driver, which are included in the control block of the image forming apparatus shown in FIGS. 3A and 3B, are made programmable, and shows the specific construction for the operator to vary manually the values of R and C in order to set the values of R and C within the compensation circuit shown in FIG. 4 in a manner to minimize the output amplitude of the AFC waveform and the APC waveform.

As apparent from FIG. 5, the servo system Z300 comprises a speed control circuit (AFC) 301, a digital-analog converter (D/A) 302, an amplifying circuit (A) 303, a compensation system circuit ($Z_{AFC}$) 304 that is made programmable in the speed control, a phase control circuit (APC) 311, a digital-analog converter (D/A) 312, an amplifying circuit (A) 313, a compensation system circuit ($Z_{APC}$) 314 that is made programmable in the phase control, a compensation system circuit ($Z_{TOTAL}$) 321 in which the synthesized portion of outputs of the speed control and the phase control is made programmable, and an amplifier 322.

The signal $Z_{TOTAL}$ amplified in the amplifier 322 is supplied to a motor driver 190. Also, the rotation of the driving motor 12*m* is fed back by the frequency generator 141 to the speed control circuit (AFC) 301 and the phase control circuit (APC) 311. It should be noted that the speed control circuit (AFC) 301 is interlocked with the compensation system circuit ($Z_{AFC}$) 304 that is made programmable in the speed control. Likewise, the phase control circuit (APC) 311 is interlocked with the compensation system circuit ($Z_{APC}$) 314 that is made programmable in the phase control.

Figure 6:
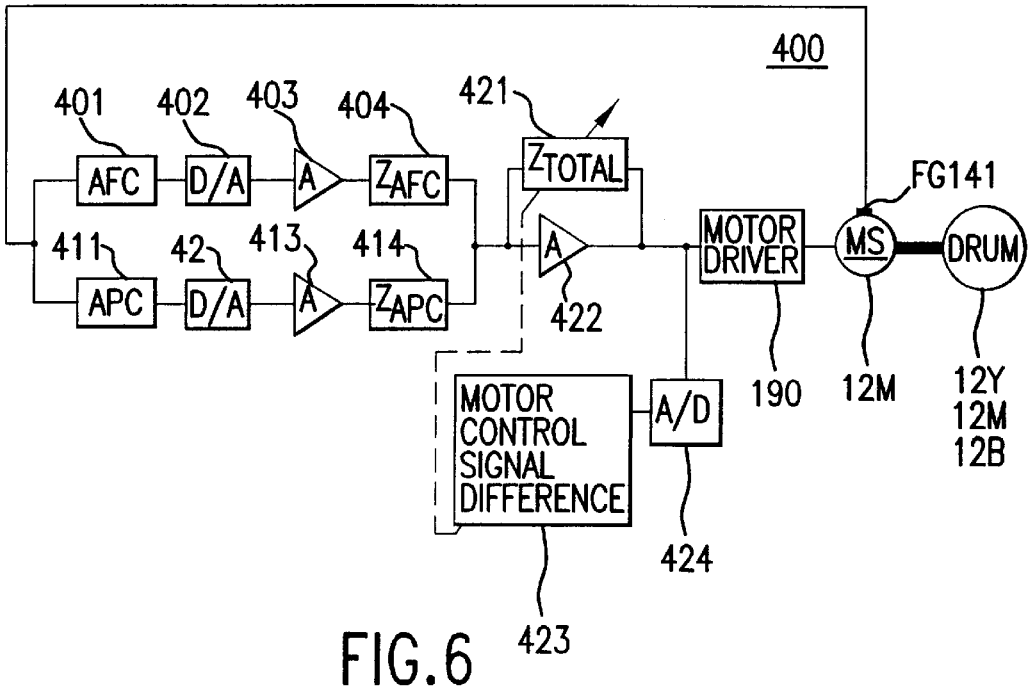
FIG. 6 is a block diagram schematically showing the circuit of a servo compensation system, in which the speed control system and the phase control system applicable to a motor driver, which are included in the control block of the image forming apparatus shown in FIGS. 3A and 3B, are made programmable in the synthesized portion of the outputs of the speed control and the phase control, said block diagram schematically showing the specific construction for making the values of R and C within the compensation circuit shown in FIG. 4 variable in order for the operator to manually vary the values of R and C so as to minimize the output amplitude of the AFC waveform and APC waveform.

FIG. 6 is a block diagram for explaining the circuit for the servo compensation system, in which the speed control system and the phase control system applicable to a motor driver, which are included in the control block of the image forming apparatus shown in FIGS. 3A and 3B, are made programmable in the synthesized portion of the outputs of the speed control and the phase control, and shows the specific construction for the operator to vary manually the values of R and C in order to set the values of R and C within the compensation circuit shown in FIG. 4 in a manner to minimize the output amplitude of the AFC waveform and the APC waveform.

As apparent from FIG. 6, the servo system 400 includes a speed control circuit (AFC) 401, a digital-analog converter (D/A) 402, an amplifying circuit (A) 403, a compensation system circuit ($Z_{AFC}$) 404 that is made programmable in the speed control, a phase control circuit (APC) 411, a digital-analog converter (D/A) 412, an amplifying circuit (A) 413, a compensation system circuit ($Z_{APC}$) 414 that is made programmable in the phase control, a compensation system circuit ($Z_{TOTAL}$) 421 in which the synthesized portion of outputs of the speed control and the phase control is made programmable, an amplifier 422, a motor control signal difference generator 423 interlocked with the compensation system circuit ($Z_{TOTAL}$) 421 in which the synthesized portion of outputs of the speed control and the phase control is made programmable, and an A/D converter 424.

The signal $Z_{TOTAL}$ amplified in the amplifier 422 and the difference signal generated from the motor control signal difference generator 423 are converted into digital signals by the A/D converter 424. The motor driving signal supplied to the motor driver 190 is synthesized with the digital signal noted above so as to form a synthesized signal. Also, the rotation of the driving motor 12*m* is fed back by the frequency generator 141 to the speed control circuit (AFC) 401 and the phase control circuit (APC) 411.

Figure 7:
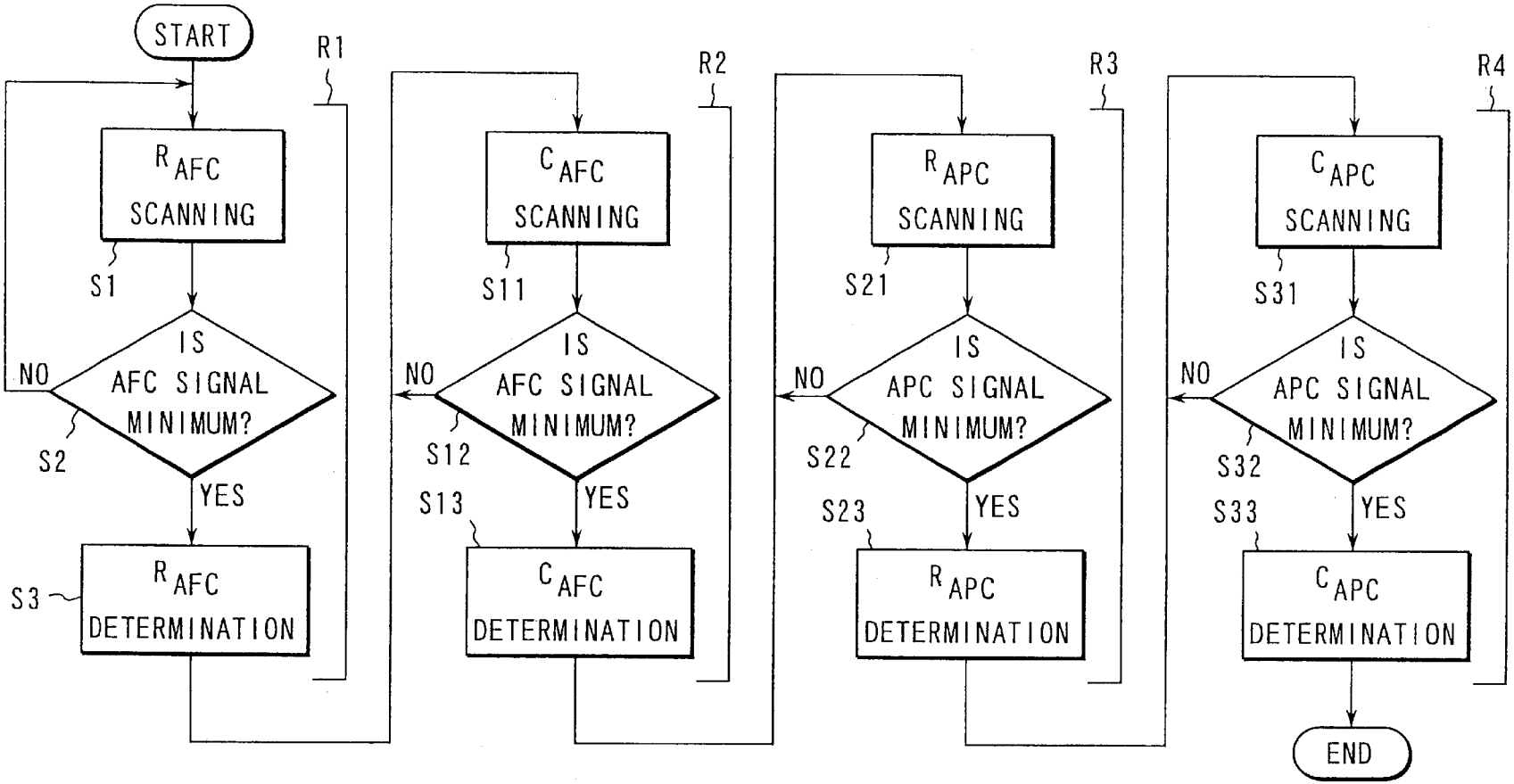
FIG. 7 is a flow chart schematically showing as an example the process for the operator to manually vary the values of R and C within the compensation circuit shown in FIG. 4 so as to minimize the output amplitude of the AFC waveform and APC waveform in a servo compensation circuit in which the speed control system and the phase control system shown in FIG. 5 are made programmable.

FIG. 7 shows as an example the process for the operator to manually make variable the values of R and C in order to set the values of R and C within the compensation circuit shown in FIG. 4 in a manner to minimize the output amplitude of the AFC waveform and the APC waveform in the circuit of the servo compensation system in which the speed control system and the phase control system shown in FIG. 5 are made programmable. As shown in the drawing, as a first routine R1, the magnitude of the variable resistor R of $Z_{AFC}$ 304 is set in step S3 so as to minimize the amplitude of the AFC signal by the repetition of steps S1 and S2. As a second routine R2, the magnitude of the variable capacitor C of $Z_{AFC}$ 304 is set in step S13 in a manner to minimize the amplitude of the AFC signal by the repetition of steps S11 and S12. Further, the magnitudes of the variable resistor R and the variable capacitor C of $Z_{APC}$ 314 are set in a third routine R3 (steps S31 to S33) and a fourth routine R4 (steps S41 to S43).

Figure 10A:
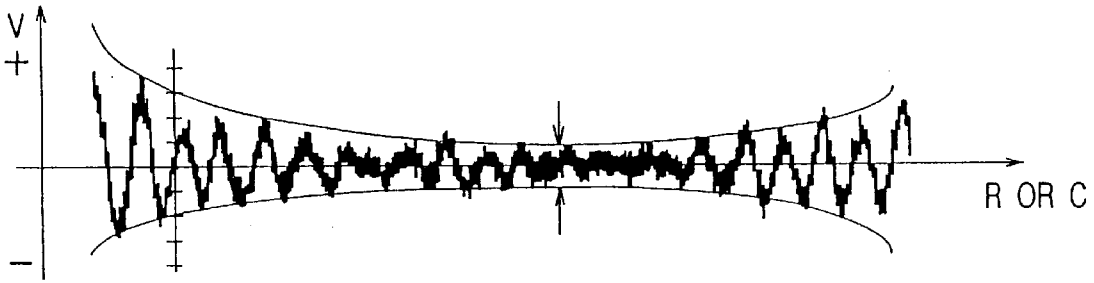
FIGS. 10A and 10B schematically explain the principle for detecting the values of $Z_{AFC}$ and $Z_{APC}$ having the smallest amplitude by successively changing the magnitudes of $Z_{AFC}$ and $Z_{APC}$ of the circuit of the compensation system shown in FIG. 5 and by measuring the waveform of the output of the speed control circuit.
Figure 10B:
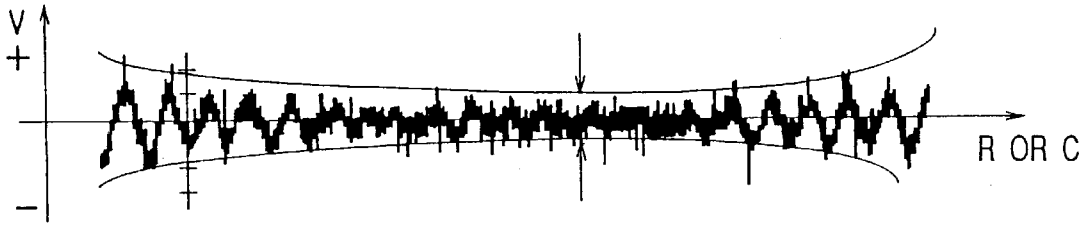

It should be noted that each of the AFC waveform and the APC waveform exhibits values ranging between an optional maximum value and the minimum value within the range of each of the resistance R and the capacitance C as shown in FIGS. 10A and 10B. It follows that each step within each of the first to fourth routines R1 to R4 is a process for looking for the position at which the amplitude becomes minimum within the ranges shown in FIGS. 10A and 10B.

Figure 8:
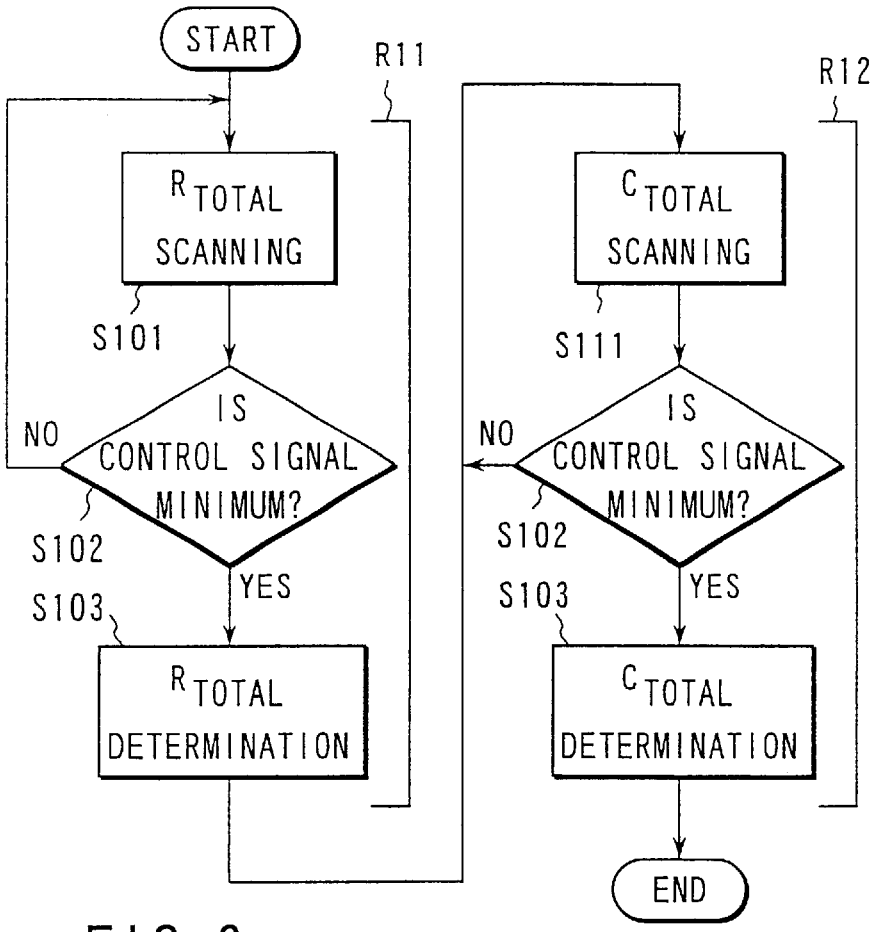
FIG. 8 is a flow chart schematically showing as an example the process for the operator to manually vary the values of R and C within the compensation circuit shown in FIG. 4 so as to minimize the output amplitude of the AFC waveform and APC waveform in a servo compensation circuit in which the speed control system and the phase control system shown in FIG. 6 are made programmable in the synthesized portion of the outputs of the speed control and the phase control.

FIG. 8 shows as an example the process for the operator to manually make variable the values of R and C in order to set the values of R and C within the compensation circuit shown in FIG. 4 in a manner to minimize the output amplitude of the AFC waveform and the APC waveform in the circuit of the servo compensation system in which the speed control system and the phase control system shown in FIG. 6 are made programmable in the synthesized portion $Z_{TOTAL}$ of the outputs of the speed control and the phase control. As shown in the drawing, as a first routine R11, the magnitude $R_{TOTAL}$ of the variable resistor R of $Z_{TOTAL}$ 421 is set in step S103 so as to minimize the amplitude of each of the AFC signal and the APC signal by the repetition of steps S101 and S102. As a second routine R12, the magnitude $C_{TOTAL}$ of the variable capacitor C of $Z_{TOTAL}$ 421 is set in step S113 in a manner to minimize the amplitude of each of the AFC signal and the APC signal by the repetition of steps S111 and S112.

It should be noted that each of the AFC waveform and the APC waveform exhibits values ranging between an optional maximum value and the minimum value within the range of each of the resistance R and the capacitance C as shown in FIGS. 10A and 10B. It follows that each step within each of the routines R11 to R12 is a process for looking for the position at which the amplitude becomes minimum within the ranges shown in FIGS. 10A and 10B.

Figure 9:
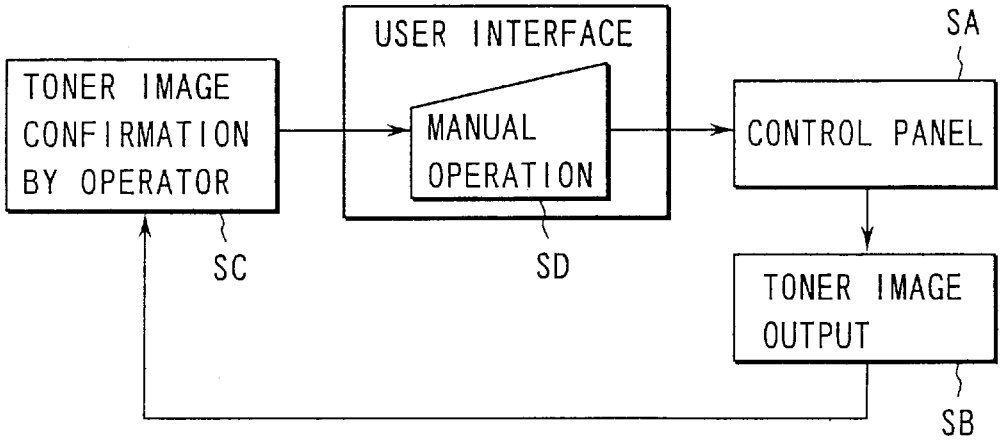
FIG. 9 schematically explains the routine for the operator such as a user or a service man to manually change the value of the compensation system by utilizing, for example, the remote control means such as a control panel or a network in the image forming apparatus shown in FIG. 1.

FIG. 9 schematically shows the routine for the operator such as a user or a service man to change manually the compensation value of the compensation system by utilizing a control panel or remote control system such as a network in respect of the image forming apparatus shown in FIG. 1. As shown in the drawing, an instruction for forming a test image is supplied from the color copying machine described in detail in conjunction with FIGS. 1, 2, 3A and 3B through a control panel 171 (step SA). Then, a predetermined image is generated from the color copying apparatus 101 (step SB). After the image (presence or absence of jitter and the degree of jitter) is confirmed by the operation (step SC), $Z_{AFC}$ or $Z_{APC}$ is changed in accordance with the step described previously in conjunction with FIG. 7 or $Z_{TOTAL}$ is changed in accordance with the process described previously in conjunction with FIG. 8 (step SD). Where a big jitter is recognized as a result of the change in $Z_{AFC}$, $Z_{APC}$ or $Z_{TOTAL}$, the routine 101 of steps SA to SD is repeated.

Needless to say, where the magnitude of the jitter falls within an allowable range as a result of the adjustment performed by the operator (input of the instructive data), the succeeding adjusting steps are stopped.

FIG. 10A schematically shows the principle for detecting the values of the resistance R and the capacitance C of $Z_{AFC}$ 304 by successively changing the magnitude of $Z_{AFC}$ 304, which is the circuit for the compensation system shown in FIG. 5, said values of the resistance R and the capacitance C of $Z_{AFC}$ 304 permitting minimizing the amplitude of the output waveform of the speed control circuit AFC 301.

To be more specific, where a waveform as shown in FIG. 10A is obtained as the output of the speed control circuit AFC 301, the magnitudes of the resistance R and the capacitance DC of $Z_{AFC}$ 304 are successively increased (or decreased) so as to obtain the amplitude of the output waveform within the range, thereby determining the magnitudes of the resistance R and the capacitance C that permit minimizing the amplitude of the output waveform of the speed control circuit AFC 301.

FIG. 10B schematically shows the principle of detecting the values of the resistance R and the capacitance C of $Z_{APC}$ by successively changing the magnitude of $Z_{APC}$, which is the circuit of the compensation system shown in FIG. 5, said values of the resistance R and the capacitance C of $Z_{APC}$ permitting minimizing the amplitude of the output waveform of the phase control circuit AFC 311.

To be more specific, where the waveform as shown in FIG. 10B is obtained as the output of the phase control circuit AFC 311, the magnitudes of the resistance R and the capacitance C of $Z_{APC}$ is successively increased (or decreased) so as to obtain the amplitude of the output waveform within the range, making it possible to determine the magnitudes of the resistance R and the capacitance C that permit minimizing the amplitude of the output waveform of the phase control circuit AFC 311.

Figure 11A:
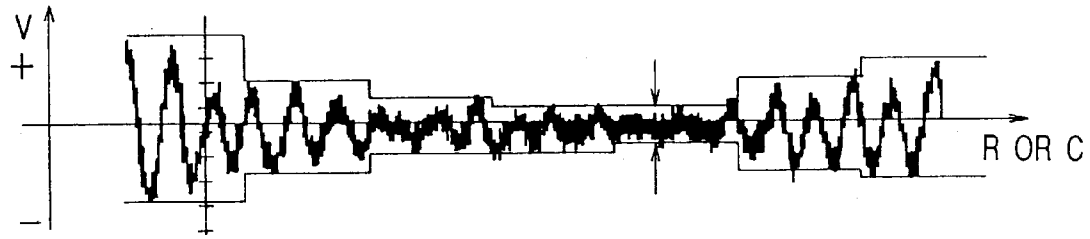
FIGS. 11A and 11B schematically explain the principle for detecting the values of $Z_{AFC}$ and $Z_{APC}$ having the smallest amplitude by successively changing in seven stages the magnitudes of $Z_{AFC}$ and $Z_{APC}$ of the circuit of the compensation system shown in FIG. 5 and by measuring the waveform of the output of the speed control circuit.

FIG. 11A schematically shows the principle of detecting the values of the resistance R and the capacitance C of $Z_{AFC}$ 304, said values permitting minimizing the amplitude of the output waveform of the speed control circuit AFC 301, by successively changing, e.g., by changing in seven stages, the magnitude of $Z_{AFC}$ 304, which is the circuit for the compensation system shown in FIG. 5.

To be more specific, where a waveform as shown in FIG. 11A is obtained as the output of the speed control circuit ARC, the magnitudes of the resistance R and the capacitance C of $Z_{AFC}$ 304 are successively increased (or decreased) in, for example, seven stages so as to obtain the amplitude of the output waveform within the range, making it possible to determine the magnitudes of the resistance value R and the capacitance C that permit minimizing the amplitude of the output waveform of the speed control circuit AFC 301. Incidentally, the step of the seven stages is determined by dividing the ranges of the variable resistor R and/or the variable capacitor C by the input from the outside or by the interval determined in advance. Then, the value of peak to peak is obtained for every interval by a sample hold circuit (not shown). The minimum value within the values of the peak to peak thus obtained is used as the magnitudes of the resistance value R and the capacitor C.

Figure 11B:
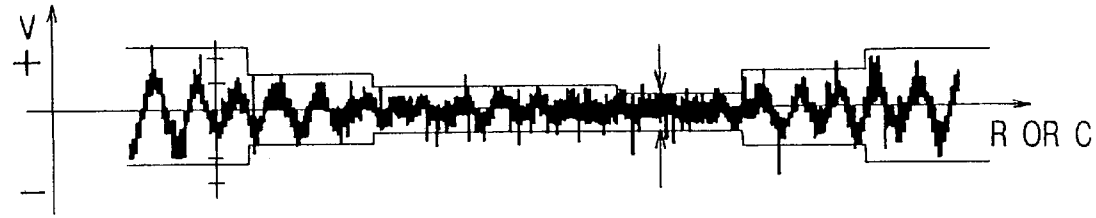

FIG. 11B schematically shows the principle of detecting the values of the resistance R and the capacitance C of $Z_{APC}$ 314, said values permitting minimizing the amplitude of the output waveform of the phase control circuit AFC 311, by successively changing, e.g., by changing in seven stages, the magnitude of $Z_{APC}$ 314, which is the circuit for the compensation system shown in FIG. 5.

To be more specific, where a waveform as shown in FIG. 11B is obtained as an output of the phase control circuit AFC 311, the magnitudes of the resistance R and the capacitance C of $Z_{APC}$ 314 are successively increased (or decreased) in, for example, seven stages, and the amplitude of the output waveform within the range is obtained, making it possible to determine the magnitudes of the resistance value R and the capacitance C that permit minimizing the amplitude of the output waveform of the phase control circuit AFC 311. Incidentally, the step of the seven stages is determined by dividing the ranges of the variable resistor R and/or the variable capacitor C by the input from the outside or by the interval determined in advance. Then, the value of peak to peak is obtained for every interval by a sample hold circuit (not shown). The minimum value within the values of the peak to peak thus obtained is used as the magnitudes of the resistance value R and the capacitor C.

Figure 12:
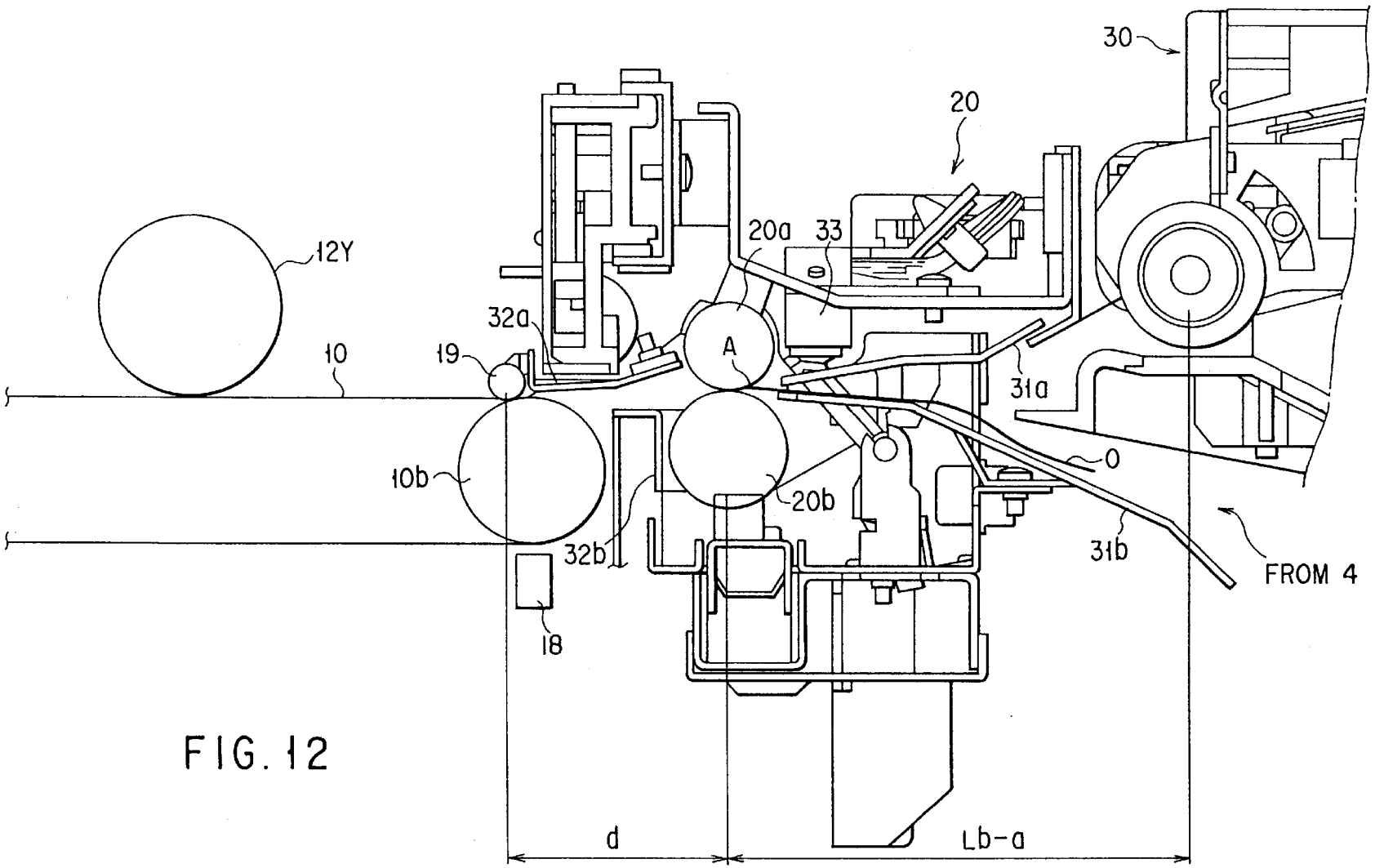
FIG. 12 schematically shows as an example the position of the sheet material for strengthening the servo in respect of any of the drum motor for rotating the photosensitive body, the aligning roller for controlling the leading edge of the sheet material, and the belt motor for driving the transfer belt in the image forming apparatus shown in FIG. 1, and shows the state that the tip of the sheet material abuts against the aligning roller so as to impart load to the aligning roller and the transfer belt motor.

FIG. 12 schematically shows as an example the position of the sheet material O for strengthening the servo in respect of any of the drum motor for rotating the photosensitive body, the aligning roller for controlling the leading edge of the sheet material O, and the belt motor for driving the transfer belt in the image forming apparatus shown in FIG. 1, and shows the state that the tip of the sheet material O abuts against the aligning rollers 20*a* and 20*b* so as to impart load to the aligning motor 20*m* and the transfer belt motor 10*m*. Therefore, the motor driving current (servo) supplied from the belt speed control circuit 192 of the motor driver 190 and from the aligning motor speed control circuit 193 to the corresponding motors is intensified at the timing at which the leading edge of the sheet material O arrives at position A shown in FIG. 12.

Figure 13:
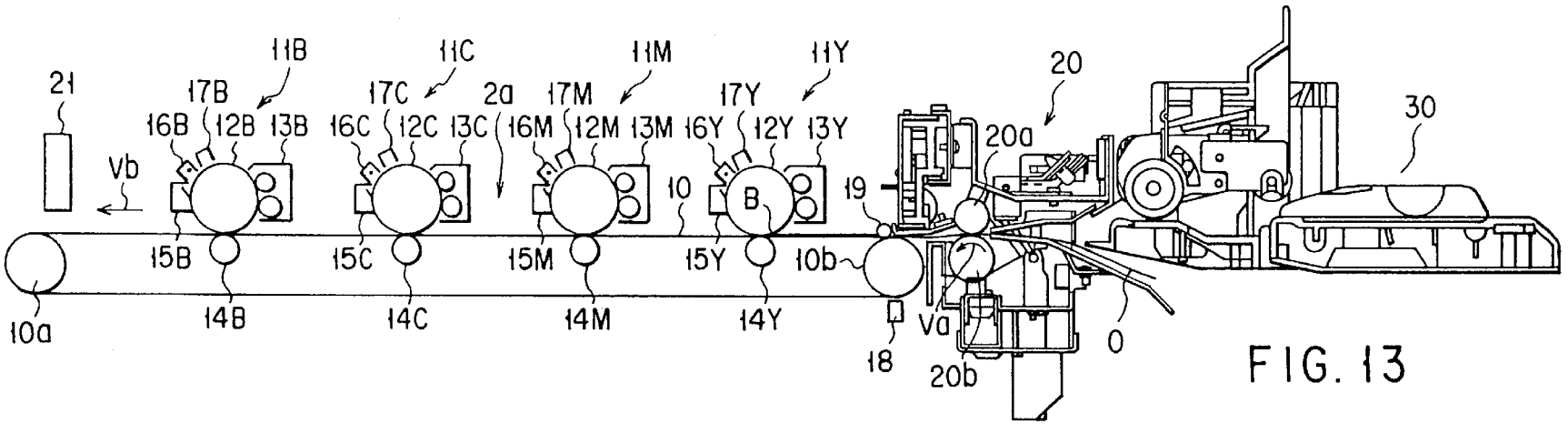
FIG. 13 schematically shows as an example the position of the sheet material for strengthening the servo in respect of any of the drum motor for rotating the photosensitive body, the aligning roller for controlling the leading edge of the sheet material, and the belt motor for driving the transfer belt in the image forming apparatus shown in FIG. 1, and shows the state that the tip of the sheet material abuts against the first photosensitive body (yellow) so as to impart load to the aligning roller and the transfer belt motor.

FIG. 13 schematically shows as an example the position of the sheet material for strengthening the servo in respect of any of the drum motor for rotating the photosensitive body, the aligning roller for controlling the leading edge of the sheet material, and the belt motor for driving the transfer belt in the image forming apparatus shown in FIG. 1, and shows the state that the tip of the sheet material abuts against the first photosensitive body (yellow) 12Y so as to impart load to the drum motor 12*m* and the transfer belt motor 10*m*. Therefore, it is seen that the motor driving current (servo) supplied from the drum speed control circuit 191 of the motor driver 190 and the belt speed control circuit 192 to the corresponding motors should be increased at the timing at which the leading edge of the sheet material O arrives at the position B shown in FIG. 13.

Figure 14:
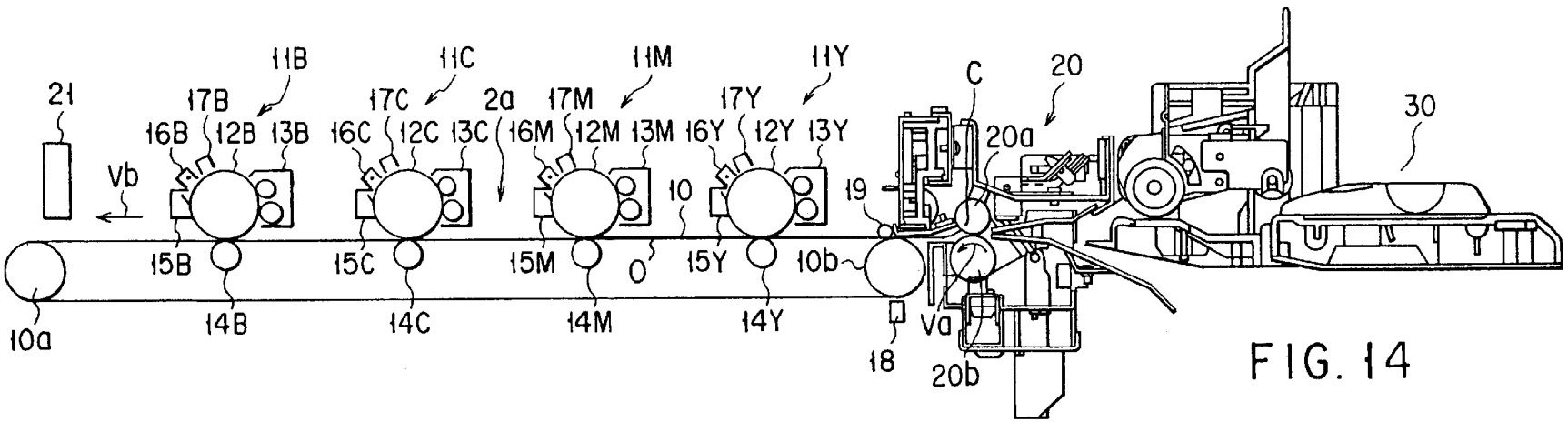
FIG. 14 schematically shows as an example the position of the sheet material for strengthening the servo in respect of any of the drum motor for rotating the photosensitive body, the aligning roller for controlling the leading edge of the sheet material, and the belt motor for driving the transfer belt in the image forming apparatus shown in FIG. 1, and shows the state that the trailing edge of the sheet material is deviated from the aligning roller so as to allow the warping force of the sheet material to impart load to the drum motor and the transfer belt motor.

FIG. 14 schematically shows as an example the position of the sheet material for strengthening the servo in respect of any of the drum motor for rotating the photosensitive body, the aligning roller for controlling the leading edge of the sheet material, and the belt motor for driving the transfer belt in the image forming apparatus shown in FIG. 1, and shows the state that the trailing edge of the sheet material is deviated from the aligning roller so as to allow the warping force of the sheet material to impart load to the drum motor and the transfer belt motor. It is seen from the drawing that motor driving current (servo) supplied from the drum speed control circuit 191 and the belt speed control circuit 192 of the motor driver 190 to the corresponding motors should be increased at the timing at which the trailing edge of the sheet material O passes through (is deviated from) the position C shown in FIG. 14.

Figure 15:
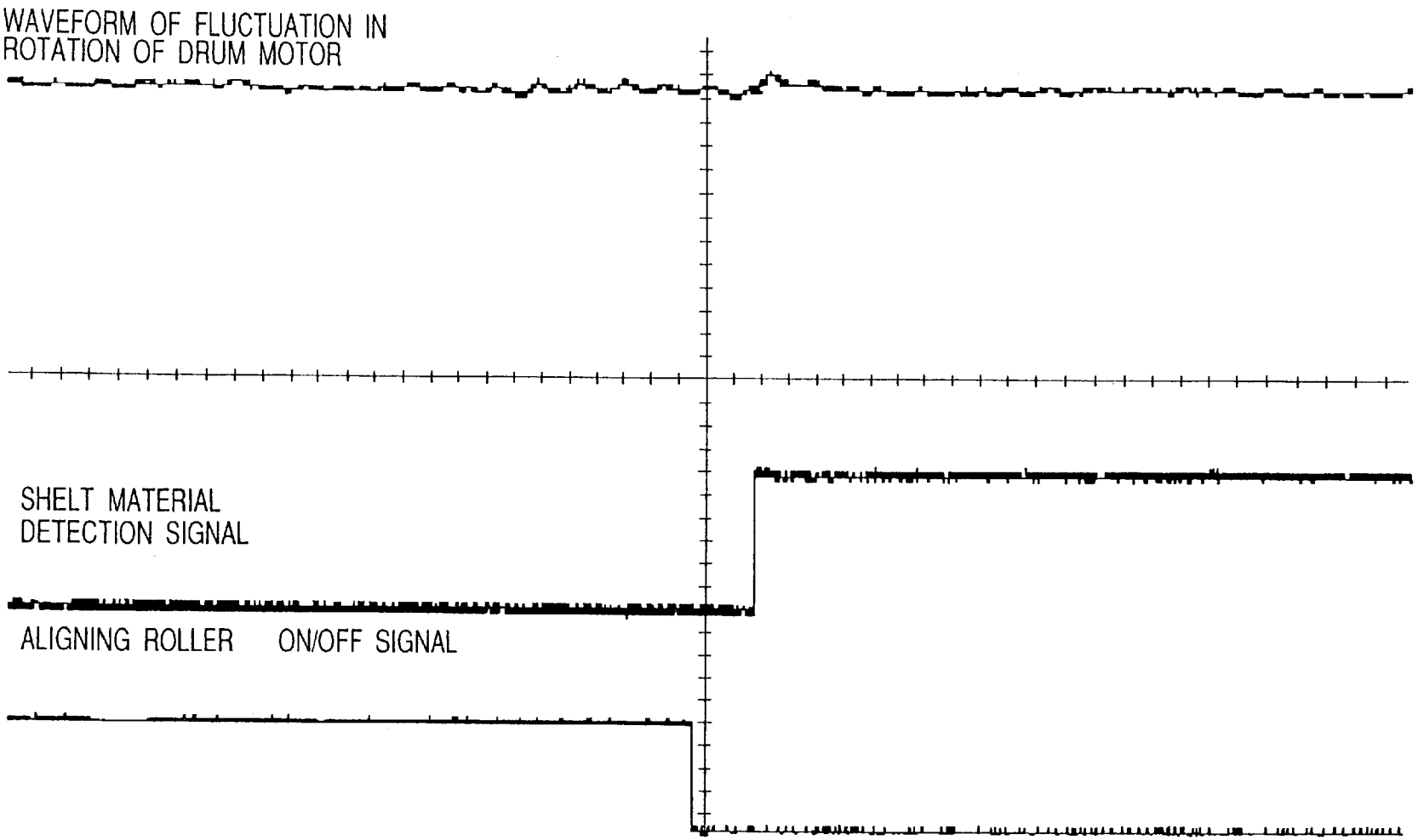
FIG. 15 is a graph for explaining as an example the waveform of the fluctuation in the rotating speed of the motor measured under the state that load is imparted to the drum motor and the transfer belt motor in order to automatically detect the leading edge of the sheet material for strengthening the servo in respect of the drum motor and the belt motor shown in FIG. 13.

FIG. 15 is a graph for explaining as an example the waveform of the fluctuation in the rotating speed of the motor measured under the state that load is imparted to the drum motor and the transfer belt motor in order to automatically detect the leading edge of the sheet material for strengthening the servo in respect of the drum motor and the belt motor shown in FIG. 13. As apparent from the drawing, the sheet material O is transferred into the clearance between the aligning rollers 20*a* and 20*b* a predetermined time after the rotation of the aligning motor 20*m* is turned on so as to instantly change the rotation of the drum motor. Therefore, it is seen that the motor driving current (servo) supplied from the drum speed control circuit 191 and the belt speed control circuit 192 of the motor driver 190 to the corresponding motors should be increased at the timing at which the leading edge of the sheet material O arrives at the position B shown in FIG. 13.

Figure 16:
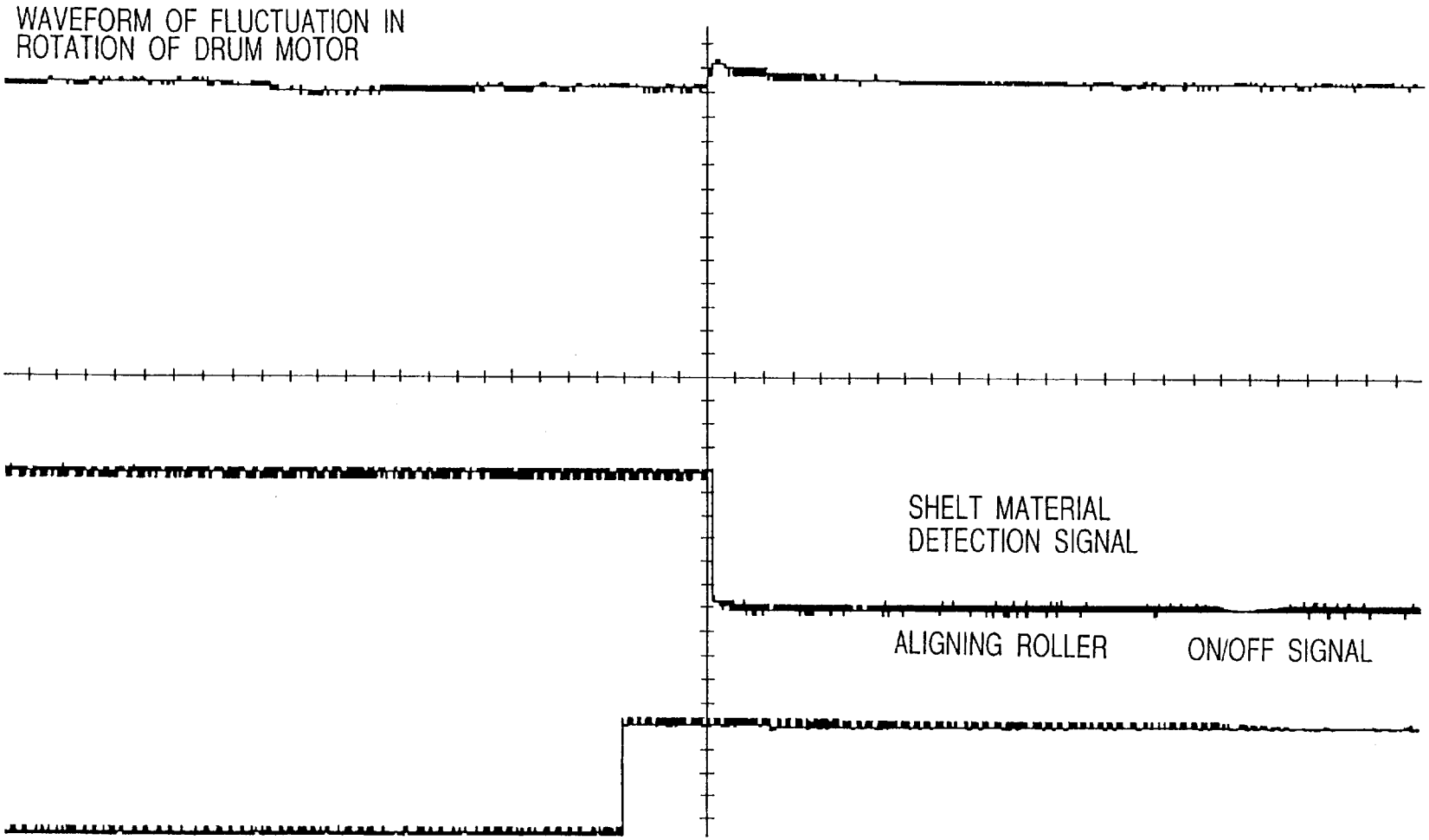
FIG. 16 is a graph showing as an example the waveform of the fluctuation in the rotating speed of the moor measured under the state that load is imparted to the drum motor and the belt motor in order to detect automatically the position of the sheet material for strengthening the servo in respect of the drum motor and the belt motor shown in FIG. 14.

FIG. 16 is a graph showing as an example the waveform of the fluctuation in the rotating speed of the moor measured under the state that load is imparted to the drum motor and the belt motor in order to detect automatically the position of the sheet material for strengthening the servo in respect of the drum motor and the belt motor shown in FIG. 14. As apparent from the drawing, the rotation of the drum motor is instantly changed at the timing at which the sheet material O is released from the clearance between the aligning rollers

20*a* and 20*b* a predetermined time, i.e., larger than the length of the sheet material O, after the rotation of the aligning motor 20*m* is turned on. Therefore, it is seen that the motor driving current (servo) supplied from the drum speed control circuit 191 and the belt speed control circuit of the motor driver 190 to the corresponding motors should be increased at the timing at which the trailing edge of the sheet material O passes through the position C shown in FIG. 14.

As described above, in the image reading apparatus of the present invention, the torque of the driving motor generating the driving force for moving the first and second carriage along the original glass or the tension applied to the wire rope for transmitting the driving force of the driving motor to the two carriages is changed in accordance with the measured resonance frequency. As a result, each of the carriages is prevented from being undesirably vibrated by the resonance with the frequency inherent in the driving motor or the wire rope. It follows that it is possible to suppress the noise contained in the image data that is read out so as to suppress deterioration of the image quality.

It should also be noted that the frequency inherent in the driving motor or the wire rope, which is changed in accordance with the sum of the number of image reading operations, is changed in accordance with the sum of the number of image reading operations in the present invention so as to provide an image quality higher than a certain level over a long period of time.

What should also be noted is that it is possible for a service man to adjust the tension applied to the wire rope and the torque of the driving motor in accordance with the sum of the number of image reading operations. It follows that it is possible to improve the quality of the image data without conducting the adjustment by dismantling even where the quality of the image data that has been read out is deteriorated in accordance with the sum of the number of image reading operations.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus, comprising:

a first motor for rotating a photosensitive member at a predetermined speed;

a second motor for transferring a transfer medium onto which the toner image formed on the photosensitive member is transferred at a speed equal to the moving speed of the photosensitive member;

a third motor for supplying the transfer medium toward the photosensitive member at a predetermined speed;

a driving device supplying driving signals to the first, second and third motors;

a detecting mechanism for detecting the occurrence of a phenomenon for changing the magnitude of the driving signals supplied from the driving device to the first, second and third motors wherein said detecting mechanism detects at least one amplitude of a motor current flowing through the first, second and third motors, an input device for changing the magnitude of the driving signals supplied from the driving device to the first, second and third motors on the basis of the occurrence of the phenomenon detected by the detecting mechanism, and a compensation condition setting mechanism for outputting the difference of at least one of a first, second and third error fluctuations when compensation constants of the motor driving currents supplied to the first, second and third motors are successively changed by said driving device.

2. The image forming apparatus according to claim 1, wherein said compensation condition setting means outputs a speed error of the first motor.

3. The image forming apparatus according to claim 1, wherein said phase compensation condition setting means outputs an error of the FG sensor output frequency to setup standard check of the first motor.

4. An image forming apparatus, comprising:

a first motor for rotating a photosensitive member at a predetermined speed;

a second motor for transferring a transfer medium onto which the toner image formed on the photosensitive member is transferred at a speed equal to the moving speed of the photosensitive member;

a third motor for supplying the transfer medium toward the photosensitive member at a predetermined speed;

a driving device supplying driving signals to the first, second and third motors;

a detecting mechanism for detecting the occurrence of a phenomenon for changing the magnitude of the driving signals supplied from the driving device to the first, second and third motors, wherein said detecting mechanism detects at least one amplitude of a motor current flowing through the first, second and third motors, a control amount setting mechanism for setting the magnitude of the driving signals supplied from the driving device to the first, second and third motors on the basis of the occurrence of the phenomenon detected by the detecting means, a compensation condition setting mechanism for outputting the difference of at least one of a first, second and third error fluctuations when compensation constants of the motor driving currents supplied to the first, second and third motors are successively changed by said driving device.

5. The image forming apparatus according to claim 4, wherein said compensation condition setting means outputs an error of the FG sensor output frequency to setup standard check of the first motor.

6. The image forming apparatus according to claim 4, wherein said driving device gives an instruction in respect of the control amount to said compensation condition setting mechanism so as to set the magnitude of the driving signal imparted to said first, second and third motors in accordance with the generation of the phenomenon for the driving device detected by said detecting device to change the magnitude of the driving signal imparted to the first, second and third motors.

7. A method of setting image forming conditions of an image forming apparatus, in which the magnitude of a jitter contained in a toner image formed in the image forming apparatus is detected and the image forming conditions are set in a manner to minimize the magnitude of the jitter, comprising the steps of:

monitoring the fluctuation in the magnitude of a motor current supplied from a motor driving device for driving a first motor to the first motor so as to detect the fluctuation in the rotating speed of the first motor;

operating a second motor for transferring a transfer medium onto which the toner image formed a photosensitive body is transferred at a speed equal to the moving speed of the photosensitive body and a third motor for supplying the transfer medium toward the photosensitive body at a predetermined speed; and setting the magnitude and the phase of the motor current supplied to the motor driving device so as to minimize the fluctuation in the rotating speed of the first motor.

8. The method of setting the image forming conditions of an image forming apparatus according to claim 7, in which the magnitude of the jitter contained in the toner image formed in the image forming apparatus is detected and the image forming conditions are set in a manner to minimize the magnitude of the jitter, wherein the magnitude of the motor current to the first motor supplied to the motor driving device is compensated on the basis of the result of the detection of the fluctuation in the load applied to the first motor.

9. The method of setting the image forming conditions of an image forming apparatus according to claim 8, in which the magnitude of the jitter contained in the toner image formed in the image forming apparatus is detected and the image forming conditions are set in a manner to minimize the magnitude of the jitter, wherein the gain of the motor driving current supplied to the motor driving device is optimized so as to minimize the amplitude of the motor current flowing through the first motor for the compensation on the basis of the detection of the fluctuation in the load applied to the first motor.

10. An image forming apparatus, comprising:

a first motor for rotating a photosensitive member at a predetermined speed;

a second motor for transferring a transfer medium onto which the toner image formed on the photosensitive member is transferred at a speed equal to the moving speed of the photosensitive member;

a third motor for supplying the transfer medium toward the photosensitive member at a predetermined speed;

a driving device supplying driving signals to the first, second and third motors;

a detecting mechanism for detecting the occurrence of a phenomenon for changing the magnitude of the driving signals supplied from the driving device to the first, second and third motors wherein said detecting mechanism detects at least one amplitude of a motor current flowing through the first, second and third motors, an input device for changing the magnitude of the driving signals supplied from the driving device to the first, second and third motors on the basis of the occurrence of the phenomenon detected by the detecting mechanism, a compensation condition setting mechanism for outputting motor driving phase fluctuations of at least one of the first, second and third motors when phase compensation impedance constants of the motor control currents supplied to the first, second and third motors are successively changed by said driving device.

11. The image forming apparatus according to claim 10, wherein said phase compensation condition setting means outputs an error of the FG sensor output frequency to setup standard check of the first motor.

12. An image forming apparatus, comprising:

a first motor for rotating a photosensitive member at a predetermined speed;

a second motor for transferring a transfer medium onto which the toner image formed on the photosensitive member is transferred at a speed equal to the moving speed of the photosensitive member;

a third motor for supplying the transfer medium toward the photosensitive member at a predetermined speed;

a driving device supplying driving signals to the first, second and third motors;

a detecting mechanism for detecting the occurrence of a phenomenon for changing the magnitude of the driving signals supplied from the driving device to the first, second and third motors wherein said detecting mechanism detects at least one amplitude of a motor current signal from an FG sensor flowing through the first, second and third motors, a control amount setting mechanism for setting the magnitude of the driving signals supplied from the driving device to the first, second and third motors on the basis of the occurrence of the phenomenon detected by the detecting means, and a compensation condition setting mechanism for outputting the difference of at least one of a first, second and third error fluctuations when the compensation constants of the motor driving currents supplied to the first, second and third motors are successively changed by said driving device.

13. A method of setting image forming conditions in correction with motor control of an image forming apparatus, in which the magnitude of a image unevenness by change of rotation of a motor contained in an image formed by the toner on the photosensitization member in the image forming apparatus is detected and the image forming conditions are set in a manner to minimize the magnitude of the jitter, comprising the steps of:

monitoring the fluctuation in the magnitude of a motor current signal from an FG sensor supplied from a motor driving device for driving a first motor to the first motor so as to detect the fluctuation in the rotating speed of the first motor;

operating a second motor for transferring a transfer medium onto which the toner image formed a photosensitization member driven by the motor is transferred at a speed equal to the moving speed of the photosensitive body and a third motor for supplying the transfer medium toward the photosensitive body at a predetermined speed; and setting the magnitude and the phase of the motor current supplied to the motor driving device so as to minimize the fluctuation in the rotating speed of the first motor.

14. The method of setting the image forming conditions of an image forming apparatus according to claim 13, in which the magnitude of the jitter contained in the toner image formed in the image forming apparatus is detected and the image forming conditions are set in a manner to minimize the magnitude of the jitter, wherein a fluctuation of at least one of a friction load and moment load which the motor is driving applied to the second and third motors is utilized as a parameter for setting the magnitude of the motor current supplied to the motor driving device.

15. The method of setting the image forming conditions of an image forming apparatus according to claim 14, in which the magnitude of the jitter contained in the toner image formed in the image forming apparatus is detected and the image forming conditions are set in a manner to minimize the magnitude of the jitter, wherein the fluctuation in the load applied by said transfer medium to the third motor is utilized as a parameter for setting the magnitude of the motor current supplied to the motor driving device.

16. The method of setting the image forming conditions of an image forming apparatus according to claim 14, in which the magnitude of the jitter contained in the toner image formed in the image forming apparatus is detected and the image forming conditions are set in a manner to minimize the magnitude of the jitter, wherein the fluctuation in the load applied by said transfer medium to the second motor is utilized as a parameter for setting the magnitude of the motor current supplied to the motor driving device.

* * * * *